US011230914B2

(12) United States Patent
Ringer et al.

(10) Patent No.: US 11,230,914 B2
(45) Date of Patent: Jan. 25, 2022

(54) SYSTEMS AND METHODS FOR DETERMINING AND/OR USING ESTIMATE OF DRILLING EFFICIENCY

(71) Applicant: GEOSERVICES EQUIPEMENTS, Roissy-en-France (FR)

(72) Inventors: Maurice Ringer, Roissy-en-France (FR); Jacques Lessi, Roissy-en-France (FR); Charles Toussaint, Singapore (SG)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 696 days.

(21) Appl. No.: 15/548,645

(22) PCT Filed: Feb. 23, 2016

(86) PCT No.: PCT/EP2016/053782
§ 371 (c)(1),
(2) Date: Aug. 3, 2017

(87) PCT Pub. No.: WO2016/135145
PCT Pub. Date: Sep. 1, 2016

(65) Prior Publication Data

US 2018/0023382 A1 Jan. 25, 2018

(30) Foreign Application Priority Data

Feb. 23, 2015 (EP) ..... 15290037

(51) Int. Cl.
*E21B 47/00* (2012.01)
*E21B 49/00* (2006.01)
(Continued)

(52) U.S. Cl.
CPC ..... *E21B 47/00* (2013.01); *E21B 41/0092* (2013.01); *E21B 44/00* (2013.01);
(Continued)

(58) Field of Classification Search
CPC ..... E21B 41/0092; E21B 44/00; E21B 47/00; E21B 47/122; E21B 47/18; E21B 49/003; E21B 47/13
See application file for complete search history.

(56) References Cited

U.S. PATENT DOCUMENTS 4,627,276 A 12/1986 Burgess et al.
5,323,648 A * 6/1994 Peltier ..... E21B 49/006 73/152.17
(Continued)

FOREIGN PATENT DOCUMENTS

EP 0466255 A2 1/1992
GB 2479383 * 10/2011 ..... E21B 44/00
(Continued)

OTHER PUBLICATIONS

Richard, T., E. Detournay, M. Fear, B. Miller, R. Clayton, and O. Matthews. "Influence of bit-rock interaction on stick-slip vibrations of PDC bits." In SPE Annual Technical Conference and Exhibition. Society of Petroleum Engineers. (Year: 2002).*
(Continued)

*Primary Examiner* — Rehana Perveen
*Assistant Examiner* — Alfred H B Wechselberger

(57) ABSTRACT

Systems and methods are provided for estimating and/or using drilling efficiency parameters of a drilling operation. A method for estimating drilling efficiency parameters may include using a borehole assembly that includes a drill bit to drill into a geological formation. A number of measurements of weight-on-bit and torque-on-bit may be obtained during a period in which weight-on-bit and torque-on-bit are non-
(Continued)

steady-state. The measurements of weight-on-bit and torque-on-bit may be used to estimate one or more drilling efficiency parameters relating to the drilling of the geological formation during the period.

8 Claims, 8 Drawing Sheets

(51) Int. Cl.

| | |
|---|---|
| ***E21B 44/00*** | (2006.01) |
| ***E21B 41/00*** | (2006.01) |
| *E21B 47/13* | (2012.01) |
| *E21B 47/18* | (2012.01) |

(52) U.S. Cl.
CPC ..... *E21B 49/003* (2013.01); *E21B 47/13* (2020.05); *E21B 47/18* (2013.01)

(56) References Cited

U.S. PATENT DOCUMENTS

| | | | | |
|---|---|---|---|---|
| 6,109,368 | A | 8/2000 | Goldman et al. | |
| 6,131,673 | A * | 10/2000 | Goldman | E21B 12/02 175/40 |
| 7,412,331 | B2 | 8/2008 | Calhoun et al. | |
| 8,274,399 | B2 * | 9/2012 | Strachan | G05B 13/048 340/853.6 |
| 8,473,435 | B2 * | 6/2013 | Ringer | G06N 7/005 706/14 |
| 9,022,140 | B2 * | 5/2015 | Marx | E21B 49/00 175/24 |
| 9,249,654 | B2 * | 2/2016 | Strachan | E21B 44/00 |
| 9,285,794 | B2 * | 3/2016 | Wang | G05B 19/0405 |
| 2003/0015351 | A1 * | 1/2003 | Goldman | E21B 44/005 175/39 |
| 2005/0109097 | A1 * | 5/2005 | Bogath | E21B 17/16 73/152.49 |
| 2014/0182934 | A1 | 7/2014 | Samuel | |
| 2014/0291023 | A1 * | 10/2014 | Edbury | E21B 21/08 175/24 |
| 2015/0247396 | A1 * | 9/2015 | Tunc | E21B 44/02 700/275 |
| 2015/0300151 | A1 * | 10/2015 | Mohaghegh | E21B 47/10 702/9 |
| 2016/0237760 | A1 * | 8/2016 | Wall | E21B 47/13 |
| 2017/0002641 | A1 * | 1/2017 | Dykstra | E21B 44/00 |
| 2018/0245446 | A1 * | 8/2018 | Astrid | G05B 13/021 |

FOREIGN PATENT DOCUMENTS

| | | | |
|---|---|---|---|
| GB | 2479383 | A | 10/2011 |
| WO | WO2004090285 | A1 | 10/2004 |

OTHER PUBLICATIONS

Detournay, E. "Drilling response of drag bits: Theory and experiment" Int. Journal of Rock Mechanics & Mining Sciences, vol. 45, pp. 1347-1360 [retrieved on Jun. 7, 2020], Retrieved from <https://www.sciencedirect.com/science/article/pii/S1365160908000245> (Year: 2008).*

Rommetveit et al. "Drilltronics: An Integrated System for Real-Time Optimization of the Drilling Process" IADC/SPE Drilling Conference [retrieved on Jun. 7, 2020], Retrieved from <https://www.onepetro.org/conference-paper/SPE-87124-MS> (Year: 2004).*

Kerkar et al. "Estimation of Rock Compressive Strength Using Downhole Weight-on-Bit and Drilling Models" IPTC 17447, Doha, Qatar [retrieved on Dec. 1, 2020]. (Year: 2014).*

Hubert, F. "Practical Evaluation of Rock-Bit Wear During Drilling" SPE Drilling and Completion [retrieved on Nov. 30, 2020] (Year: 1993).*

Chinnam et al. "Autonomous Diagnostics and Prognostics Through Competitive Learning Driven HMM-Based Clustering" Proceedings of the International Joint Conference on Neural Networks, 2003; doi: 10.1109/IJCNN.2003.1223951 [retrieved on Jun. 6, 2021] (Year: 2003).*

Ertunc et al. "Real Time Monitoring of Tool Wear Using Multiple Modeling Method" IEMDC 2001. IEEE International Electric Machines and Drives Conference (Cat. No. 01EX485); DOI: 10.1109/IEMDC.2001.939388 [retrieved on Jun. 6, 2020] (Year: 2001).*

Van Quickelberghe et al. "A new procedure to analyse the wear of cutting elements" Proceedings of the International Symposium of the International Society for Rock Mechanics, Eurock 2006, Liege, Belgium [retrieved on Jun. 6, 2020] (Year: 2006).*

Falconer et al., Separating Bit and Lithology Effects from Drilling Mechanics Data, IADC/SPE Drilling Conference held in Dallas, Texas, Feb. 28-Mar. 2, 1988, SPE 17191 (14 pages).

Dunlop et al., Increased Rate of Penetration Through Automation, SPE 139897, SPE/IADC Drilling Conference and Exhibition held in Amsterdam, The Netherlands, Mar. 1-3, 2011 (11 pages).

H Geoffroy, D Nguyen Minh, J Bergues, C Putot, "Frictional contact on cutters wear flat and evaluation of drilling parameters of a PDC bit", SPE 47323, SPE/ISRM Eurock held in Trondheim, Norway, Jul. 8-10, 1998, (10 pages).

E Detournay, P Defourny, "A Phenomenological model for the drilling action of drag bits", Int Journal of Rock Mech and Mining Sci, No. 29, 1992.

DJ Berndy, J Clifford, "Using Dynamic Time Warping to Find Patterns in Time Series", AAAI Tech Report WS-94-03, Apr. 1994. (12 pages).

Teale R, "The Concept of Specific Energy in Rock Drilling", Int J Rock Mech. Mining Sci. vol. 2, 57-73, 1965.

Jonathan Dunlop et al., "Optimizing ROP through automation—Algorithm interprets drilling mechanics data to automatically control drilling parameters", Sep. 21, 2011.

Extended Search Report issued in the related EP Application 15290037.9, dated Jul. 24, 2015 (14 pages).

International Search Report and Written opinion issued in the related PCT Application PCT/EP2016/053782, dated Jun. 1, 2016 (15 pages).

* cited by examiner

SYSTEMS AND METHODS FOR DETERMINING AND/OR USING ESTIMATE OF DRILLING EFFICIENCY

BACKGROUND

This disclosure relates to determining and/or using an estimate of drilling efficiency (e.g., intrinsic energy of rock or wear on a drill bit) while a well is drilled.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

To drill a well, a drill bit attached to a drill string is rotated and pressed into a geological formation. Drilling fluid may be pumped down into the drill string to mechanically power the rotation of the drill bit and to help remove rock cuttings out of the borehole. The drill bit may drill through portions of the geological formation having different intrinsic energies, also referred to as rock strengths. The higher the intrinsic energy of the portions of the geological formation, the more energy the drill bit may use to cut through the rock. Furthermore, over time, the drill bit will wear down from cutting through the rock. As wear on the drill bit increases, it may become less efficient to use that drill bit to drill the well.

In many cases, the intrinsic energy of the rock and the estimated wear of the drill bit may be determined using models based on steady-state measurements of weight-on-bit (WOB) and torque-on-bit (TOB) and other measurements such as Rate-of-penetration (ROP) and rotation speed (Rotation-Per-Minute or RPM). In this disclosure, the term WOB refers to an amount of downward force that is being applied to the drill bit to cause the drill bit to cut through the geological formation. The term TOB refers to an amount of torque that is being applied to the drill bit to cause the drill bit to cut through the geological formation. Once the steady-state values of WOB and TOB are obtained, estimates of intrinsic energy and drill bit wear may be computed. The estimates of intrinsic energy and drill bit wear may be presented in a well log, which may be used by drilling specialists to determine how to control certain aspects of drilling. The well logs currently in use, however, may not enable drilling specialists to identify or use certain useful aspects of this information. Moreover, estimates of intrinsic energy and drill bit wear obtained using steady-state measurements of WOB and TOB may not fully account for depths where drilling is not steady state.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

This disclosure relates to systems and methods for estimating and/or using drilling efficiency parameters of a drilling operation. In one example, a method for estimating drilling efficiency parameters may include using a borehole assembly that includes a drill bit to drill into a geological formation. A number of measurements of weight-on-bit and torque-on-bit may be obtained during a period in which weight-on-bit and torque-on-bit are non-steady-state. The plurality of measurements of weight-on-bit and torque-on-bit may be used to estimate one or more drilling efficiency parameters relating to the drilling of the geological formation during the period.

In another example, a system includes a borehole assembly that includes a drill bit that drills into a geological formation as a weight-on-bit and a torque-on-bit is applied, a measuring assembly, and a data processing system. The drill bit may wear down as the drill bit drills through depths of the geological formation to a greater extent through parts of the geological formation having a greater intrinsic energy. The measuring assembly may obtain a number of measurements of weight-on-bit and torque-on-bit, at least during a period in which weight-on-bit and torque-on-bit are non-steady-state. The data processing system may use the measurements of weight-on-bit and torque-on-bit to estimate one or more drilling efficiency parameters relating to the drilling of the geological formation during the period.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
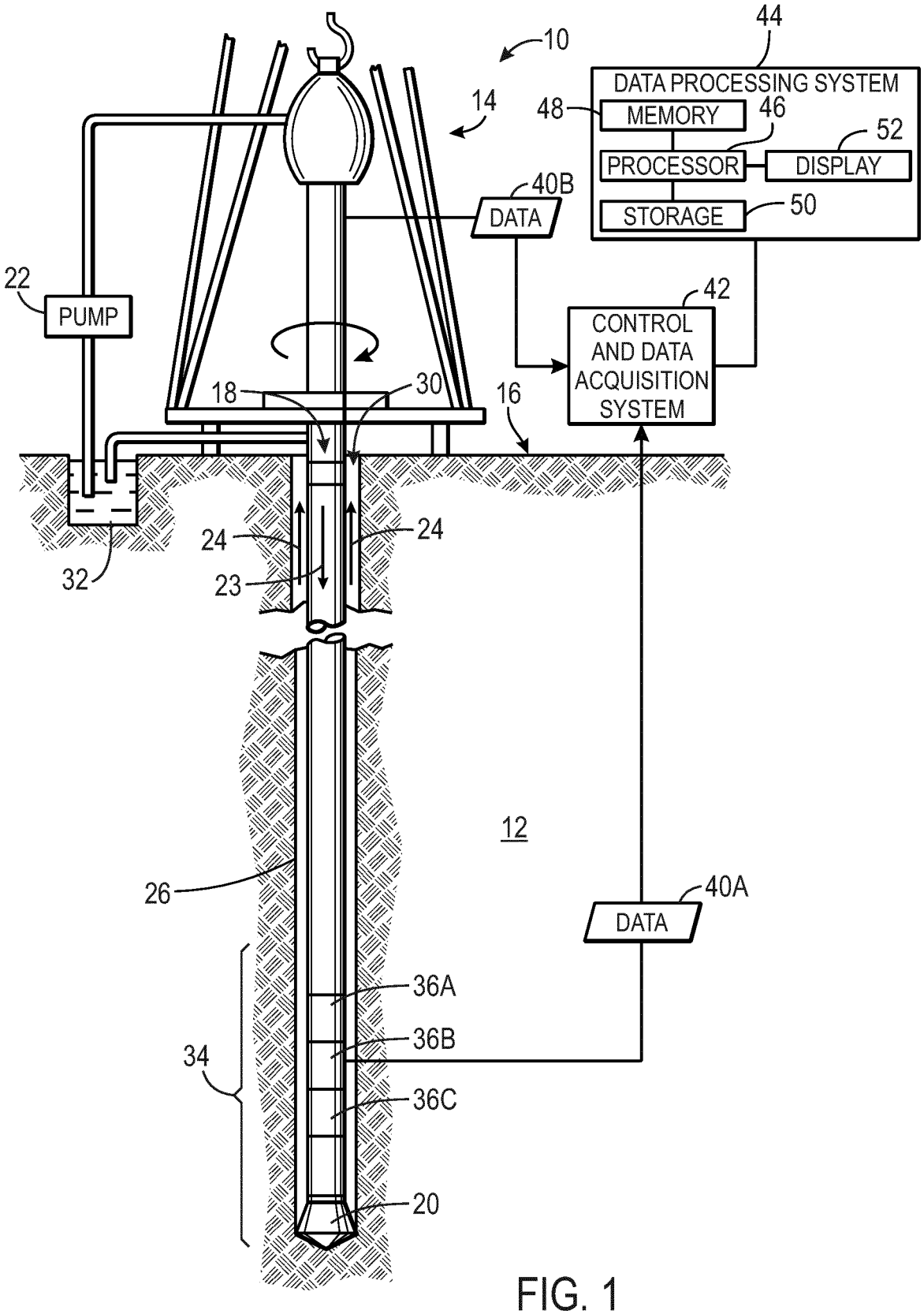
FIG. 1 is a schematic diagram of a drilling system in accordance with an embodiment.

One or more specific embodiments of the present disclosure will be described below. These described embodiments are examples of the presently disclosed techniques. Additionally, in an effort to provide a concise description of these embodiments, features of an actual implementation may not be described in the specification. It should be appreciated that in the development of any such actual implementation, as in any engineering or design project, numerous implementation-specific decisions may be made to achieve the developers' specific goals, such as compliance with system-related and business-related constraints, which may vary from one implementation to another. Moreover, it should be appreciated that such a development effort might be complex and time consuming, but would be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As noted above, a drill bit may drill through portions of the geological formation having different intrinsic energies, also referred to as rock strengths. The higher the intrinsic energy of the portions of the geological formation, the more energy the drill bit may use to cut through the rock. Furthermore, over time, the drill bit will wear down from cutting through the rock. The wear on the drill bit is also related to the intrinsic energy of the rock in the geological formation that the drill bit has cut through. As wear on the drill bit increases, it may become less efficient to use that drill bit to drill the well. In fact, at some point, it may be useful to take time to "trip" the drill bit—that is, pull out the drill string and replace the drill bit with one that has less wear—and resume drilling with the new drill bit. Tripping the bit, however, may take several hours to several days. Time not spent drilling may be expensive, but may be cost effective if the newly replaced drill bit allows the well to be completed sooner than otherwise.

In this disclosure, certain parameters associated with drilling efficiency may be determined and presented. In some examples of this disclosure, this drilling efficiency information may be provided in a well log that more easily allows a drilling specialist to identify the efficiency of ongoing, prior, or even future drilling operations. In fact, in some examples, the provided well log may enable a drilling specialist to more easily identify an optimal time to trip the drill bit given a possible future rate of penetration in the event that the drill bit is replaced.

This disclosure will also describe determining drilling efficiency parameters using weight-on-bit (WOB) and torque-on-bit (TOB) measurements obtained during non-steady-state periods of drilling when WOB and TOB are changing. Such non-steady-state periods may include drill-on and drill-off periods. During a drill-on period, drilling is resumed after inactivity. The WOB and TOB ramp up from lower values to higher values as drilling is resumed. During a drill-off period, WOB and TOB ramp down from higher values to lower as drilling pauses or ends.

An Example Drilling System

FIG. 1 illustrates a drilling system 10 that may be used to detect and/or provide drilling efficiency information in the manner mentioned above. The drilling system 10 may be used to drill a well into a geological formation 12. In the drilling system 10, a drilling rig 14 at the surface 16 may rotate a drill string 18 having a drill bit 20 at its lower end. As the drill bit 20 is rotated, a drilling fluid pump 22 is used to pump drilling fluid 23, which may be referred to as "mud" or "drilling mud," downward through the center of the drill string 18 in the direction of the arrow to the drill bit 20. The drilling fluid 23, which is used to rotate, cool, and/or lubricate the drill bit 20, exits the drill string 18 through the drill bit 20. The drilling fluid 23 then carries drill cuttings away from the bottom of a wellbore 26 as it flows back to the surface 16, as shown by the arrows, through an annulus 30 between the drill string 18 and the formation 12. However, as described above, as the drilling fluid 23 flows through the annulus 30 between the drill string 18 and the formation 12, the drilling mud 23 may begin to invade and/or mix with formation fluids stored in the formation (e.g., natural gas or oil). At the surface 16, return drilling fluid 24 is filtered and conveyed back to a mud pit 32 for reuse.

As illustrated in FIG. 1, the lower end of the drill string 18 includes a bottom-hole assembly (BHA) 34 that may include the drill bit 20 along with various downhole tools (e.g., 36A and/or 36B). The downhole tools 36A and/or 36B are provided by way of example, as any suitable number of downhole tools may be included in the BHA 34. The downhole tools 36A and/or 34B may collect a variety of information relating to the geological formation 12 and the state of drilling the well. For instance, the downhole tool 36A may be a logging-while-drilling (LWD) tool that measures physical properties of the geological formation 12, such as density, porosity, resistivity, lithology, and so forth. Likewise, the downhole tool 36B may be a measurement-while-drilling (MWD) tool that measures certain drilling parameters, such as the temperature, pressure, orientation of the drilling tool, and so forth. In certain examples of this disclosure, the downhole tool 36B may ascertain a weight-on-bit (WOB) and a torque-on-bit (TOB) during non-steady-state drilling (e.g., drill-on periods when drilling resumes after some inactivity or drill-off periods when drilling pauses or ends). In some examples, the downhole tool 36B may obtain measurements of WOB or TOB during steady-state drilling.

The downhole tools 36A and/or 36B may collect a variety of data 40A that may be stored and processed in the BHA 34 or, as illustrated in FIG. 1, may be sent to the surface for processing via any suitable telemetry (e.g., electrical signals pulsed through the geological formation 12 or mud pulse telemetry using the drilling fluid 24). The data 40A relating to WOB and TOB may be sent to the surface immediately or over time during steady-state drilling. Additionally or alternatively, WOB and TOB may be ascertained at the surface and provided as data 40B. The data 40A and/or 40B may be sent via a control and data acquisition system 42 to a data processing system 44.

The data processing system 44 may include a processor 46, memory 48, storage 50, and/or a display 52. The data processing system 44 may use the WOB and TOB information of the data 40A and/or 40B to determine certain drilling efficiency parameters. To process the data 40A and/or 40B, the processor 46 may execute instructions stored in the memory 48 and/or storage 50. As such, the memory 48 and/or the storage 50 of the data processing system 44 may be any suitable article of manufacture that can store the instructions. The memory 46 and/or the storage 50 may be ROM memory, random-access memory (RAM), flash memory, an optical storage medium, or a hard disk drive, to name a few examples. The display 52 may be any suitable electronic display that can display the well logs and/or other information relating to properties of the well as measured by the downhole tools 36A and/or 36B. It should be appreciated that, although the data processing system 44 is shown by way of example as being located at the surface, the data processing system 44 may be located in the downhole tools 36A and/or 36B. In such embodiments, some of the data 40A may be processed and stored downhole, while some of the data 40A may be sent to the surface (e.g., in real time). This may be the case particularly in LWD, where a limited amount of the data 40A may be transmitted to the surface during drilling operations.

Figure 2:
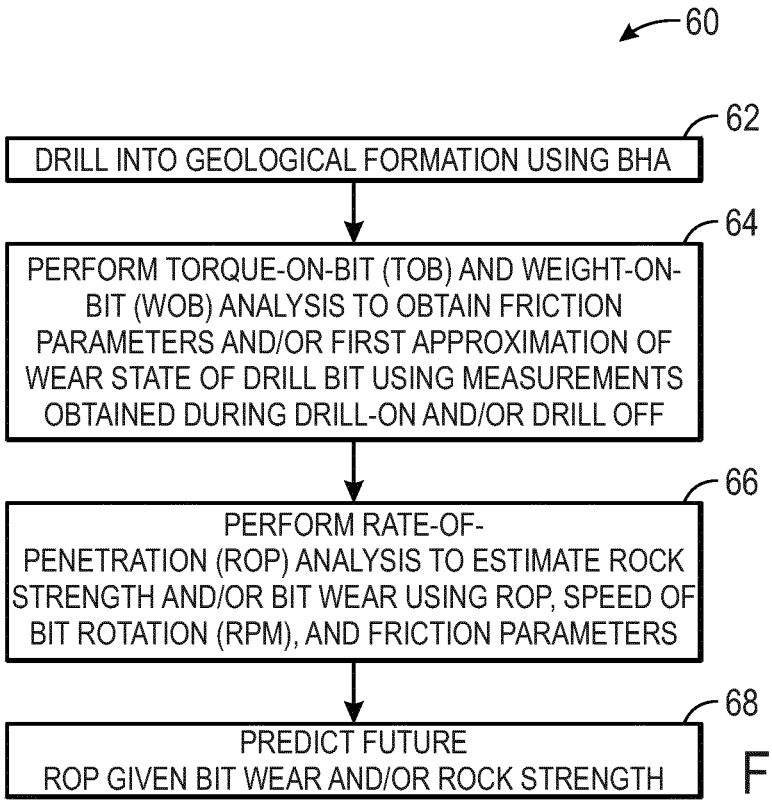
FIG. 2 is a flowchart of a method for using the drilling system of FIG. 1 to estimate current and/or future drilling efficiency parameters, in accordance with an embodiment.

A method for monitoring the efficiency of drilling and/or predicting future drilling performance appears in a flowchart 60 of FIG. 2. The actions mentioned in the flowchart 60 are described here in brief, and are expanded on further below in relation to other figures. The flowchart 60 begins when the BHA 34 is used to drill into the geological formation 12 (block 62). Drilling into the formation 12 is not continuous, however, but rather includes periods of steady-state drilling and periods of inactivity. When drilling resumes after a period of inactivity ("drill-on"), the weight-on-bit (WOB) and torque on-bit (TOB) ramp up from lower values to higher values until a steady state is reached. When drilling ends or pauses ("drill-off") after some period of steady-state drilling, WOB and TOB ramp down from higher values to lower values until drilling pauses or ends. Using these values of WOB and TOB obtained during drill-on or drill-off (or any other suitable period of non-steady-state drilling), a TOB and WOB analysis may be performed to obtain parameters relating to drilling efficiency (block 64). These drilling efficiency parameters may include friction parameters that describe frictional characteristics of the bit-rock interaction and/or a first approximation of bit wear.) These parameters may include in-situ strength of the rock ε, parameters relating to the friction between the bit and the rock ζ and μ, and/or a first approximation of a wear state $A_w$ of the drill bit 20 as as provided by a model that uses these parameters.

Using the drilling efficiency parameters obtained from the analysis of block 64 or from other calculations (e.g., from steady-state measurements of WOB and TOB at the surface), a rate-of-penetration (ROP) analysis may be performed (block 66). This may involve determining rock strength or bit wear using an estimate of rate of penetration (ROP), speed of bit rotation (RPM), and/or the drilling efficiency parameters. From this information, the future ROP may be estimated (block 68), as well as other parameters in relationship with drilling efficiency.

Weight-On-Bit (WOB) and Torque-On-Bit (TOB) Analysis Using Non-Steady-State Measurements Before discussing the uses of drilling efficiency parameters such as friction parameters and bit wear, a discussion of a manner of analysis to determine these parameters using measurements during non-steady-state drilling is set. Specifically, as noted above with reference to blocks 62 and 64 of the flowchart 60 of FIG. 2, periods of drilling during which weight-on-bit (WOB) and torque-on-bit (TOB) are changing may be used to determine certain drilling efficiency values. These non-steady-state periods of drilling include drill-on and drill-off periods. As mentioned previously, in a drill-on period, the WOB and TOB ramp up from lower values to higher values as drilling is resumed after a period of inactivity. During a drill-off period, WOB and TOB ramp down from higher values to lower as drilling pauses or ends.

Figure 3:
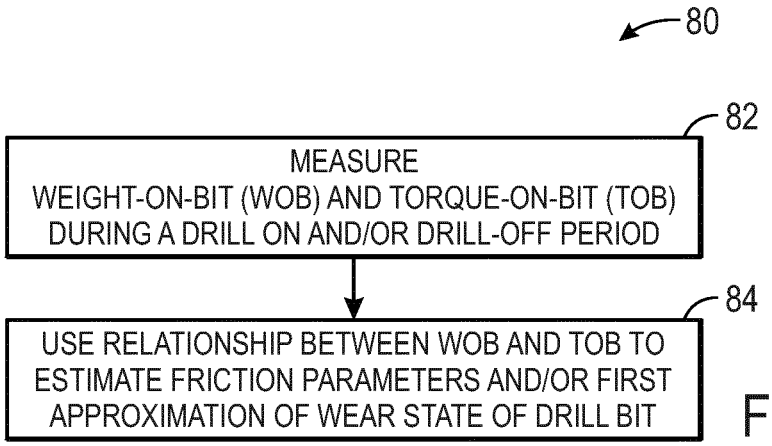
FIG. 3 is a flowchart of a method for estimating friction parameters and/or a first approximation of a wear state of a drill bit, in accordance with an embodiment.

A flowchart 80 of FIG. 3 describes an example of the WOB and TOB analysis corresponding to block 62 of the flowchart 60 of FIG. 2. In the flowchart 80 of FIG. 3, measurements of WOB and TOB may be measured during a drill-on period or during a drill-off period (or both) (block 82). These may be measurements performed at a relatively high frequency, that are obtained approximately every second or so (e.g., 1 measurement every few seconds, 1 measurement per second, or more than 1 measurement per second). The measurements may be inferred from measurements of weight and torque on the surface or obtained by a suitable downhole tool 36 (e.g., strain gauge). Based on a relationship between WOB and TOB during non-steady-state drilling periods, an estimate of certain drilling efficiency parameters may be obtained (block 84). These parameters may include in-situ strength of the rock ε, parameters relating to the friction between the bit and the rock ζ and μ, and/or a first approximation of a wear state of the drill bit 20 as provided by a model that uses these parameters.

Any suitable model that describes the relationship between WOB and TOB during non-steady-state drilling periods may be used to identify the drilling efficiency parameters. One non-limiting example of such a model is shown below:

$$WOB = \zeta \varepsilon r_b \frac{ROP}{RPM} + A_w \varepsilon f\left(\frac{ROP}{RPM}\right); \text{ and} \quad \text{(EQ. 1)}$$

$$TOB = \frac{1}{2}\varepsilon r_b^2 \frac{ROP}{RPM} + \mu r_b A_w \varepsilon f\left(\frac{ROP}{RPM}\right); \quad \text{(EQ. 2)}$$

where

WOB is the weight on the bit;

TOB is the torque experienced by the bit;

ROP is the rate of penetration;

RPM is the bit rotation speed;

$r_b$ is the radius of the bit;

$\varepsilon$ is the energy used to cut the rock, that is, the in-situ strength of the rock;

$A_w$ is the area of the wear flat (the amount of bit wear); and $\zeta$ and $\mu$ are friction parameters relating to the friction between the bit and the rock—that is, a friction parameter of the drill bit 20 and a friction parameter of the geological formation 12.

In EQ. 1 and EQ. 2, above, the function $f(\cdot)$ defines the behaviour of the friction on the wear flats as the depth-of-cut is increased. The drilling efficiency parameters of this model are $\varepsilon$, $A_w$, $\zeta$ and $\mu$, and these describe the state of the cutting process. The aim is to estimate these parameters from measurements of WOB, TOB, ROP, and RPM.

Figure 4:
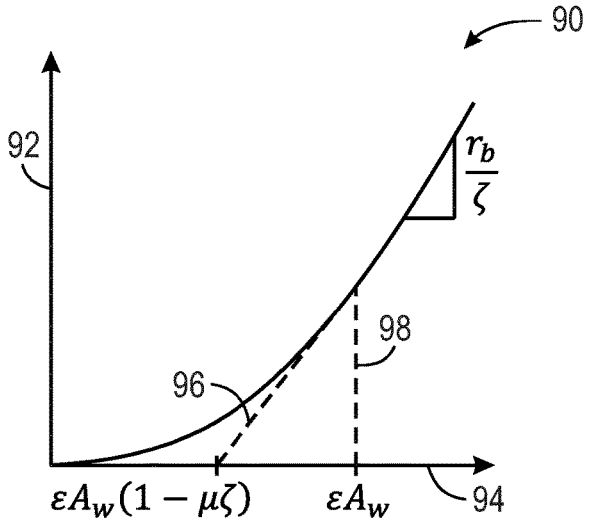
FIG. 4 is a plot of a relationship between weight-on-bit (WOB) and torque-on-bit (TOB) when WOB and TOB are in a non-steady state, such as during drill-on and drill-off, in accordance with an embodiment.

Using a model such as described by EQ. 1 and EQ. 2, the actions of block 64 of the flowchart 60 of FIG. 3 may take place in any suitable manner to estimate $\varepsilon$, $A_w$, $\zeta$ and $\mu$. One way to do so may involve fitting a curve to a crossplot of TOB vs. WOB (made over some analysis window). FIG. 4 represents a crossplot 90 of weight-on-bit (WOB) and torque-on-bit (TOB) simulated as being measured during a drill-on or a drill-off period. An ordinate 92 of the plot 90 represents increasing values of TOB and an abscissa 94 represents increasing values of WOB. The crossplot 90 shows the nonlinear relationship of TOB and WOB when drilling starts during a drill-on period or pauses or ends during a drill-off period up to a steady-state point (e.g., as demarcated by an intersection of the crossplot 90 with a line 98). Beyond the steady-state point, the relationship between TOB and WOB may be substantially linear.

Using a crossplot of WOB and TOB such as the crossplot 90 of FIG. 4, it may be possible to estimate $\zeta$, $\mu$ and the product $\varepsilon A_w$, as illustrated. In general, analysis of the TOB vs WOB measurements provides information on the friction between the bit and the rock and a first approximation of the wear state of the bit. Indeed, a line 96 extending back from the steady-state portion of crossplot 90 along the slope $$\left(\frac{r_b}{\zeta}\right)$$

of the steady-state portion of the crossplot 90 may be identified that corresponds to a point representing $\varepsilon A_w(1-\mu\zeta)$. A line 98 may be identified that corresponds to a point representing $\varepsilon A_w$. By identifying these values in this way, the parameters $\varepsilon A_w$, $\zeta$ and $\mu$ may be estimated.

For this stage of the analysis, it is useful for the measurements of WOB and TOB to be taken while the weight is ramping up or decreasing, as this provides a sweep (a range) of data points on the cross-points and improves the robustness of fitting a model. When drilling, weight (and thus torque) may be held fairly constant (at the requested drilling weight) during steady-state periods; however, the sweeps of weight will occur whenever the bit is lowered to bottom during "drill-on," when weight increases from zero to the requested drilling weight, and when the bit is raised off bottom during "drill-off," when weight ramps down from the drilling weight to zero. These "drill-on" and "drill-off" periods may occur directly after and just prior to a connection (e.g., when a new section of drillpipe is added to the drill string 18).

Collecting the sweep of WOB and TOB data used for the analysis of block 84 may occur at the surface or downhole. In one example of a flowchart 110, illustrated in FIG. 5, the WOB and TOB measurements may be collected by the downhole tool 36 during drill-on or drill-off (block 112). The downhole tool 36 may obtain the WOB and TOB measurements in any suitable way (e.g., a strain gauge). The downhole tool 36 may detect when a drill-on or drill-off event occurs, or may be instructed that such an event is about to occur by the surface, and may obtain these measurements. The downhole tool 36 may obtain the WOB and TOB measurements at a higher sampling rate than could be immediately provided to the surface via a telemetry system used by the downhole tool 36. For instance, measurements at a higher sampling rate than about one per second (e.g., 1 measurement every few seconds, at least 1 measurement per second, or an average of more than 1 measurement per second) may produce more data than could be sent in real time through the telemetry system. Indeed, in many telemetry systems, such as many mud pulse telemetry, EM telemetry, and acoustic wave propagation systems, bandwidth may be about 10-20 bits/sec, or about one measurement every 1-2 seconds at best. Even if the telemetry system of the downhole tool 36 could provide the bandwidth to send the measurements uphole to the surface in real time, there may be other data that would benefit from being sent uphole at that time.

As such, the measurements of WOB and TOB that are collected during the drill-on or drill-off period by the downhole tool 36 may be stored and transmitted uphole gradually as the data 40A during steady-state drilling or when drilling pauses or ends (block 114). When drilling a stand of drillpipe, the time taken to drill-on and drill-off may be small compared the time taken to drill the stand. That is, after a connection, when the weight is applied, the drill-on might occur over a period of time from a few seconds to maybe a minute. After that, when the desired drilling weight is reached, the remainder of the stand may take anything from, for example, 10 minutes to many hours to drill.

Figure 5:
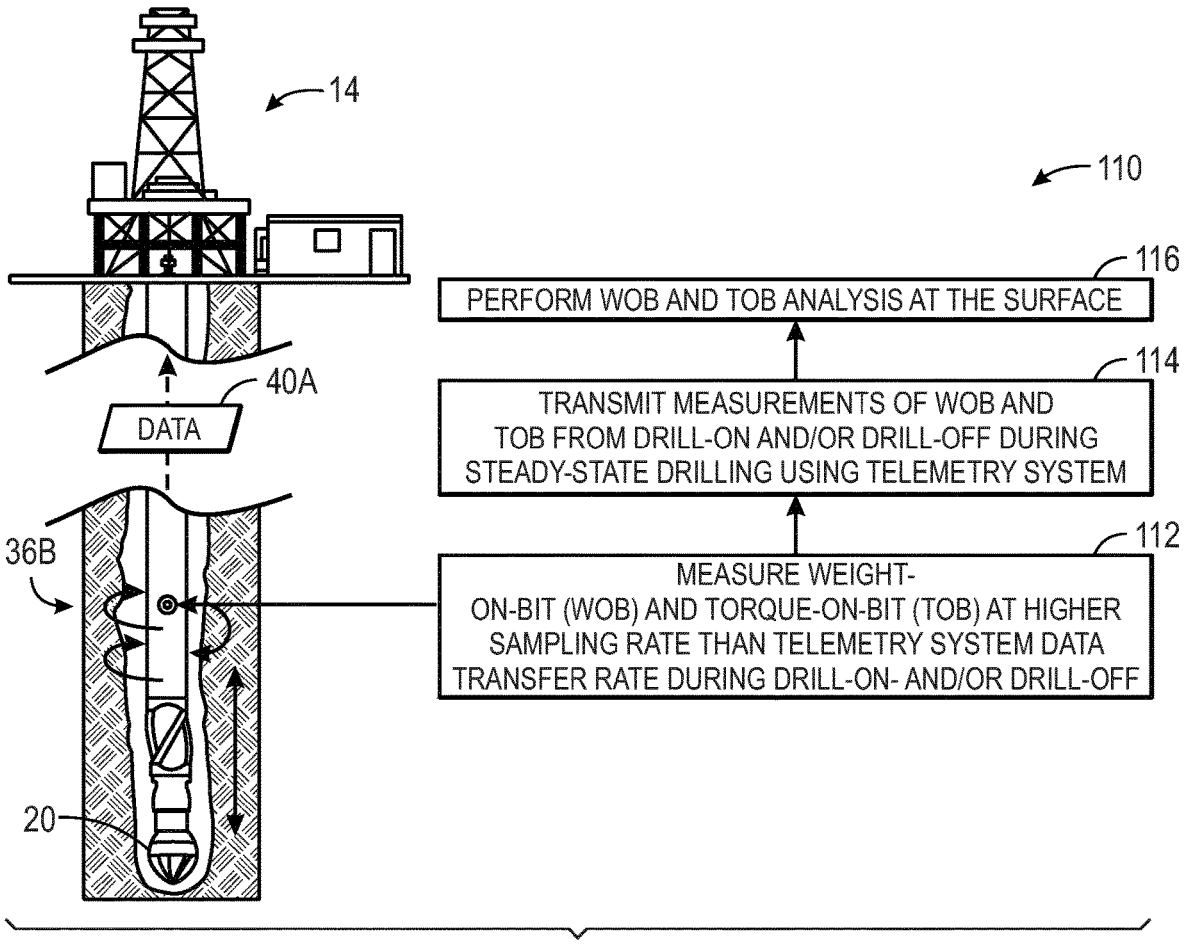
FIG. 5 is a diagram and corresponding flowchart of a method for obtaining WOB and TOB measurements during drill-on or drill-off and transmitting the measurements to the surface, in accordance with an embodiment.

The manner of transmission of block 114 of FIG. 5 may take place in any suitable way. In one example, an extra data point may be added to the data frames being transmitted during normal drilling (that is, the extra data points may be used to transmit the entire drill-on slowly in between other data while drilling). In another example, the entire drill-on sequence may be transmitted after it has completed, using transmission technology such as Schlumberger's "frame on demand" technology. The time involved to transmit the data from the drill-on may take longer than the drill-on itself, but still may be short compared to the time involved to drill the stand.

Once transmitted to the surface, the measurements of WOB and TOB may be used in the analysis mentioned above at block 64 to determine an estimate of the drilling efficiency parameters (block 116). Note that the analysis of drilling efficiency and bit wear may be desired when ROP is slow, when there is more time to transmit the data to the surface.

Figure 6:
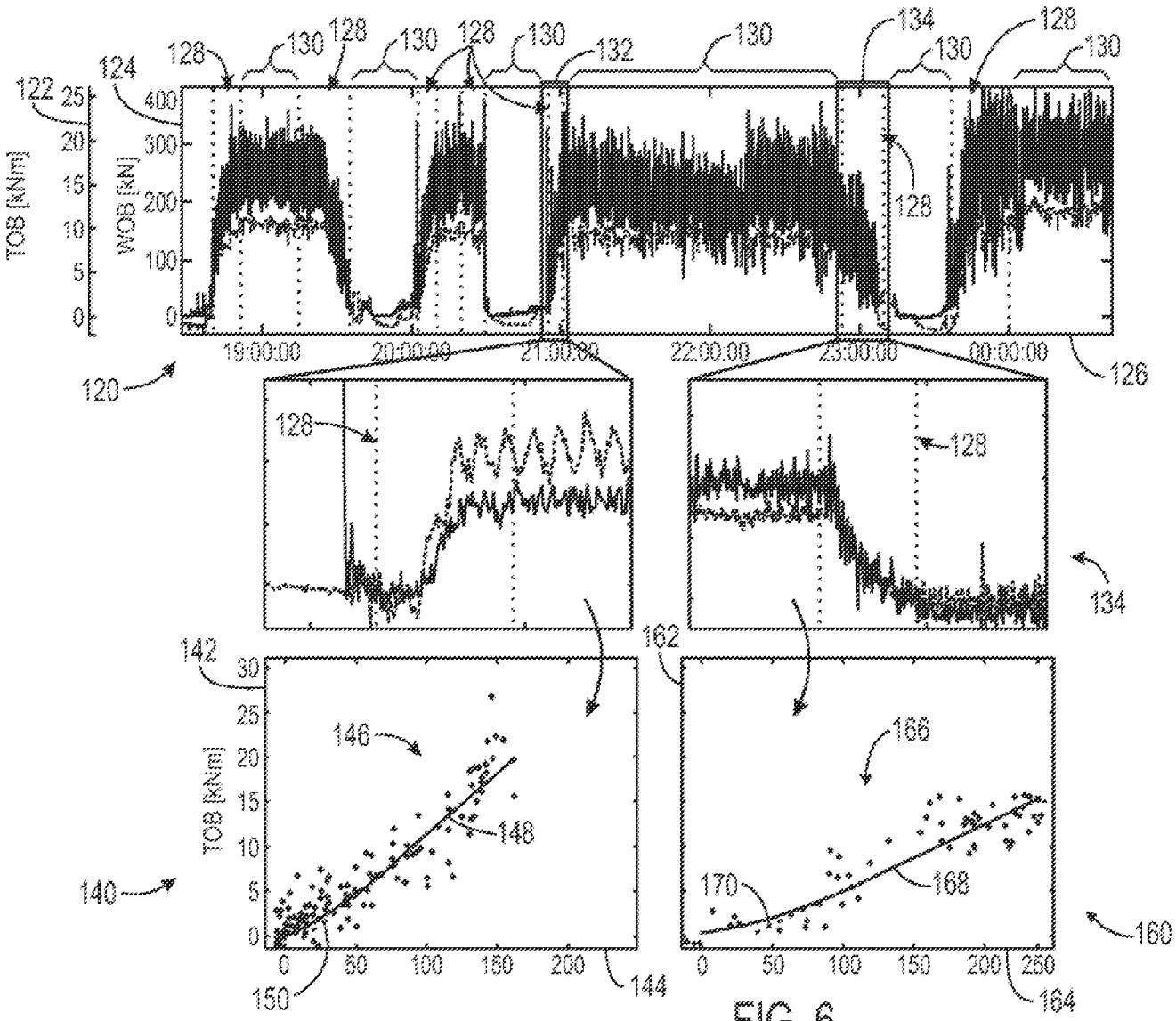
FIG. 6 represents a collection of plots of WOB and TOB simulated as having been obtained during drill-on and drill-off, in accordance with an embodiment.

The method of the flowchart 110 of FIG. 5 is also shown by way of example in FIG. 6. In FIG. 6, a well log 120 shows TOB represented along a first ordinate 122 and WOB represented along a second ordinate 124 in relation to time in an abscissa 126. Non-steady-state periods 128 (e.g., drill-on and drill-off periods) are shown adjacent to steady-state periods 130. A well log portion 132 shows a close view of a drill-on period and a well log portion 134 shows a close view of a drill-off period occurring in the well log 120.

The WOB and TOB data obtained during the drill-on period shown by the well log portion 132 may be used to generate a crossplot 140. In the manner mentioned above, TOB (ordinate 142) vs. WOB (abscissa 144) contains a variety of data points 146 from the well log portion 132. By fitting a curve 148 to the data points 146, a line 150 corresponding to the line 96 of the crossplot 90 may be obtained. This may allow values of $\varepsilon A_w$, $\zeta$ and $\mu$ to be identified from from the crossplot 140.

Likewise, the WOB and TOB data obtained during the drill-off period shown by the well log portion 134 may be used to generate a crossplot 160. In the manner mentioned above, TOB (ordinate 162) vs. WOB (abscissa 164) contains a variety of data points 166 from the well log portion 134. By fitting a curve 168 to the data points 166, a line 170 corresponding to the line 96 of the crossplot 90 may be obtained. This may allow values of $\varepsilon A_w$, $\zeta$ and $\mu$ to be identified from from the crossplot 160.

Figure 7:
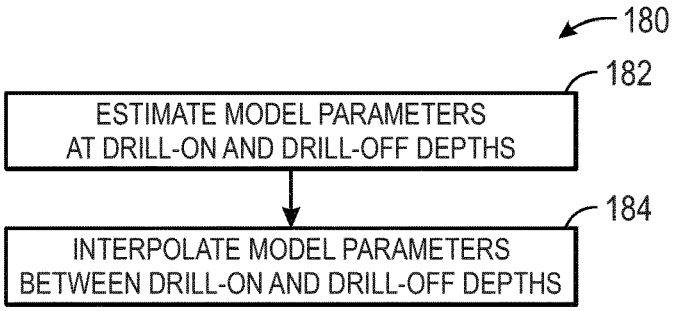
FIG. 7 is a flowchart of a method for obtaining a more complete data set through interpolation of the model parameters between drill-on and drill-off depths, in accordance with an embodiment.

As noted by a flowchart 180 of FIG. 7, whether a downhole tool 36 is used to measure WOB and TOB or whether these measurements are inferred from surface, the result of this first stage of processing is an estimate of some of the model parameters (e.g., $\varepsilon A_w$, $\zeta$ and $\mu$) at drill-drill-on or drill-off periods (block 182). These parameters can then be interpolated onto times during which weight was steady (e.g., when there were no drill-ons or drill-offs) and also projected onto depth (block 184). Thus, a depth log of these model parameters may be created.

Estimation of Current and/or Future Drilling Efficiency Based on Model Values The analysis discussed in this section of the disclosure generally corresponds to blocks 66 and 68 of the flowchart 60 of FIG. 2. The model parameters, whether obtained by the techniques disclosed above or obtained through steady-state WOB and TOB analysis, may be used to analyze current drilling efficiency and/or even to predict future drilling efficiency. In one example, WOB, TOB, ROP and RPM may be averaged over intervals of depth, in conjunction with the model parameters previously estimated, to estimate the remaining model parameters. The particular remaining model parameters may include a refined value of the bit wear and in-situ rock strength.

Separating the estimation of current and/or future drilling efficiency described in this section of the disclosure from the solving of the model parameters estimated in the previous section of the disclosure may allow for more precise and/or more accurate estimates than otherwise. Specifically, since ROP is measured at surface (from block motion), the measurement of ROP during the drill-on and drill-off periods may be of comparatively low quality, while the depth-averaged ROP may be far more trustworthy. Moreover, the manner of estimating the remaining parameters can incorporate a depth-based constraint (e.g., bit wear must remain steady or decrease with increasing depth). Other information may also be considered. For instance, estimating the remaining parameters can incorporate any other suitable depth-based information, such as logs of rock strength gained from offset wells (e.g., from wireline tools).

Figure 8:
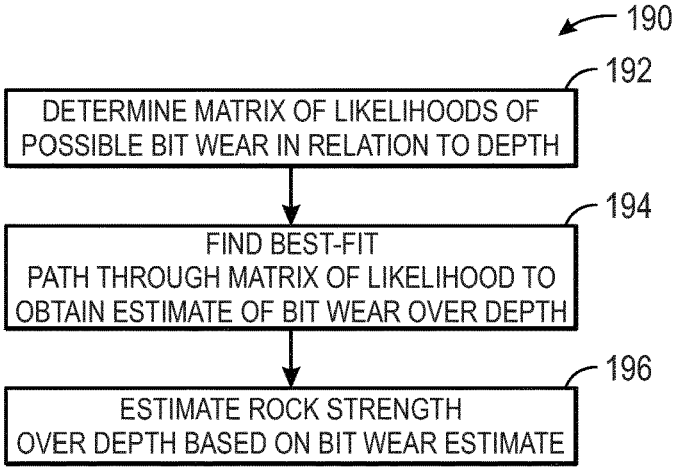
FIG. 8 is a flowchart of a method for estimating rock strength over depth based on a drill bit wear estimate using any suitable model parameters, including model parameters obtained as discussed with reference to FIGS. 2-7, in accordance with an embodiment.
Figure 9:
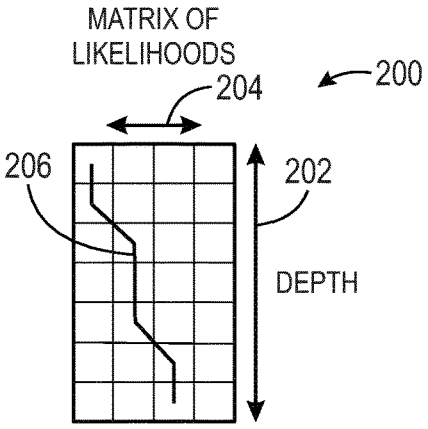
FIGS. 9 and 10 are examples of using a matrix of likelihoods to estimate drill bit wear over some depth, in accordance with an embodiment.
Figure 10:
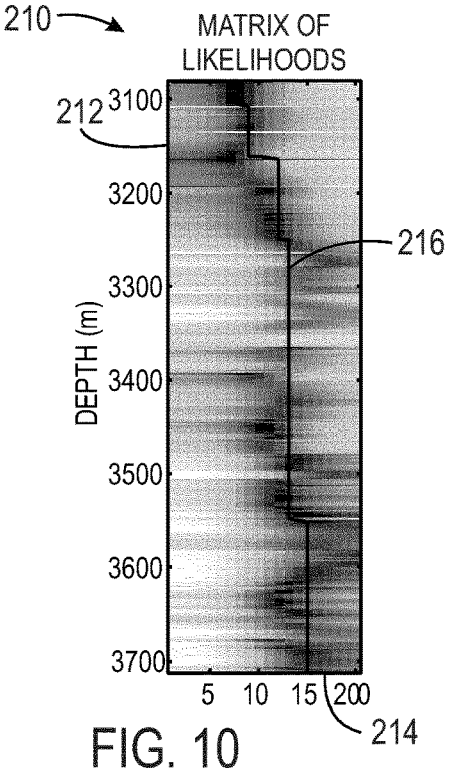

One example of estimating the remaining model parameters and/or current or future drilling efficiency may take place as shown in a flowchart 190 of FIG. 8. In the flowchart 190, a best-fit path may be identified through a matrix of likelihoods of actual drill bit wear to estimate a refined value of rock strength. It takes into account he bit wear at different depths for determining the bit wear at one depth. Thus, the flowchart 190 may begin as drill bit wear may be estimated and assigned a likelihood of being correct given the estimated model parameters for each depth and/or previously obtained logs of rock strength or other measurements, producing a matrix of likelihoods of possible drill bit wear over depth (block 192). FIGS. 9 and 10 each provide an example of a matrix of likelihoods for this purpose. Still considering the flowchart 190 of FIG. 8, using the matrix of likelihoods, a best-fit path may be searched that produces a most likely bit wear over the depths (block 194). Using the most likely bit wear over the depths, a corresponding rock strength $\varepsilon$ may be determined using any suitable model (e.g., the model introduced above) (block 196).

A matrix of likelihoods of bit wear may be generated in any suitable way. In one example, at any depth, it is possible to propose a value of bit wear to test. For example, a suitable range of possible values of bit wear that could reasonably be expected to represent the actual value of drill bit wear may be used. For each selected proposed value of bit wear, it is then possible to use the model to predict some of the measurements, and to compare these modeled values to the true measurements. The model discussed above may be used for this purpose, but it should be appreciated that any other suitable model may be used that can be used to estimate bit wear and, accordingly, a likelihood of bit wear given the currently known parameters. Thus, the process may be repeated at different depths and for different proposed values of bit wear. In one example, the following relationship may be used:

$$-L(d, A_w) = \frac{|WOB(d) - \widehat{WOB}(d, A_w)|^2}{\sigma_W^2} + \frac{|TOB(d) - \widehat{TOB}(d, A_W)|^2}{\sigma_T^2} \quad \text{EQ. 3}$$

where

WOB(d) and TOB(d) are the measurements of WOB and TOB at depth d.

$\widehat{WOB}(d,A_w)$ and $\widehat{TOB}(d,A_w)$ are the modelled values of WOB and TOB at depth d d and bit wear $A_w$.

$\sigma_W^2$ and $\sigma_T^2$ are the measurement uncertainty (variance) on WOB and TOB.

The result is a matrix of likelihoods, L, which gives the likelihood of a given bit wear $A_w$ at a given depth. FIGS. 9 and 10 each provide an example of a matrix of likelihoods that may result. In FIG. 9, a matrix of likelihoods 200 shows a vertical axis 202 illustrating depth against a horizontal axis 204 of different values of bit wear $A_w$. A best-fit curve 206 may be made to fit through the matrix of likelihoods. Here, the best-fit curve 206 has been constrained only to increase or remain substantially unchanged with depth, since it may not be possible to have a reduced amount of bit wear $A_w$ as depth increases.

FIG. 10 provides another particular example of a matrix of likelihoods 210. As in the example of FIG. 9, the matrix of likelihoods 210 shows a vertical axis 212 illustrating depth against a horizontal axis 214 of different values of bit wear $A_w$. An amount of shading in FIG. 10 indicates the likelihood of each value of drill bit wear for each depth, in which darker shading implies a higher likelihood and lighter shading implies a lower likelihood. In an actual implementation, color may be used in place of, or in addition to, such shading. For example, a bluer color may indicate a higher likelihood and a green or red may indicate lower likelihoods. Considering the likelihoods indicated by the amount of shading shown in FIG. 10, it may be appreciated that a best-fit curve 216 can be identified in the matrix of likelihoods 210 as traversing through the darker-shaded portions of the matrix of likelihoods 210. As shown in FIG. 10, the best-fit curve 216 may be constrained only to increase with depth.

Solving for the best path through a matrix of likelihoods may be done using any suitable technique. In one example, a Dynamic Time Warping (DTW) algorithm may be used. Note also that other techniques may be employed, for example, to weakly constrain the bit wear. Moreover, the algorithm could be have any other pattern; for instance, it may allow small decreases in bit wear if the resulting total likelihood is improved beyond some threshold amount of overall likelihood (e.g., above some threshold value of a sum of the likelihoods along the determined path or average value of the likelihood along the determined path).

Having determined a likely value of bit wear, a likely value of rock strength may be estimated. That is, for a given estimate of bit wear, it may be possible to estimate the rock strength ε (as all other variables of the model now may be known). For example, using the model model previously proposed above, the rock strength ε can be estimated one of two ways:

$$WOB = \zeta\varepsilon r_b \frac{ROP}{RPM} + A_w \varepsilon f\left(\frac{ROP}{RPM}\right) \rightarrow \varepsilon = \frac{WOB}{\zeta r_b \frac{ROP}{RPM} + A_w f\left(\frac{ROP}{RPM}\right)};; \text{ or} \quad \text{EQ. 4}$$

$$TOB = \frac{1}{2}\varepsilon r_b^2 \frac{ROP}{RPM} + \mu r_b A_w \varepsilon f\left(\frac{ROP}{RPM}\right) \rightarrow \varepsilon = \frac{2TOB}{r_b^2 \frac{ROP}{RPM} + 2\mu r_b A_w f\left(\frac{ROP}{RPM}\right)}. \quad \text{EQ. 5}$$

Values of rock strength ε may also be calculated using both equations and averaged together to make the estimate of rock strength ε more robust.

Additionally or alternatively, the method may also estimate the bit wear $A_w$ from the drilling efficiency parameters obtained from the measurements taken from non-steady state period in combination with the rock strength obtained from a log such as a sonic log, directly via the estimation of $\varepsilon A_w$ or with via other measurements of WOB, TOB, ROP and RPM taken as explained above.

Figure 11:
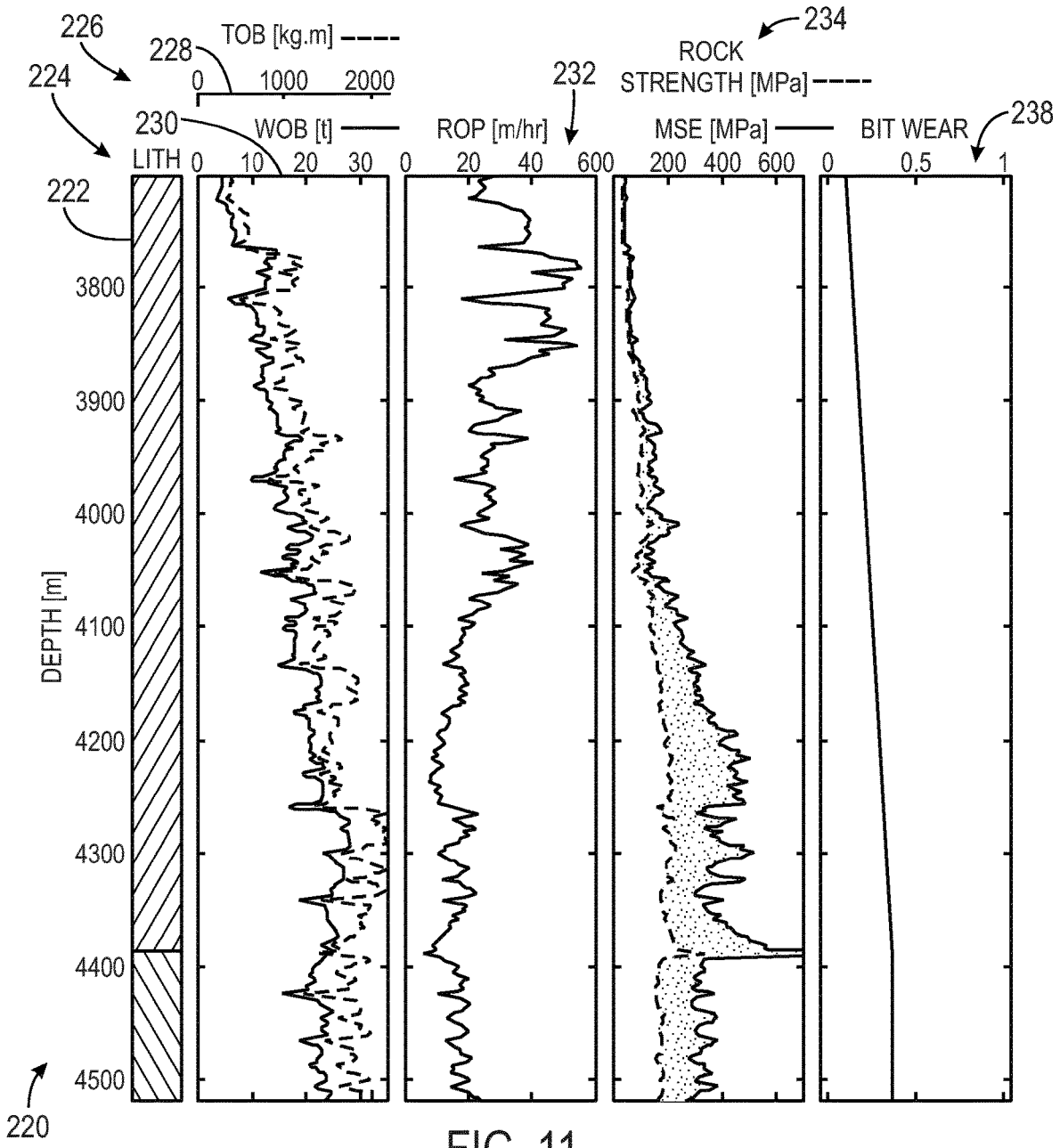
FIG. 11 is an example of a well log that illustrates a determined estimate of rock strength alongside mechanical specific energy (MSE) for some depth, which provides an indication of drilling efficiency to the extent rock strength deviates from MSE, in accordance with an embodiment.

The refined estimates of rock strength and bit wear may be presented in a way that allows a drilling specialist to easily identify the drilling efficiency of the drilling operation. One example appears in a well log 220 of FIG. 11. In the well log 220, several tracks are provided over a range of depths 222. A first track 224 illustrates lithology; a second track 226 illustrates torque-on-bit (TOB) (dashed line 228) and weight-on-bit (WOB) (solid line 230); a third track 232 illustrates rate of penetration (ROP); a fourth track 234 illustrates rock strength (dashed line) and mechanical specific energy (MSE) (solid line); and a fifth track 238 illustrates bit wear as a value between 0 (no wear) and 1 (completely worn).

The well log 220 may be notable not only for providing the estimates of rock strength and bit wear alongside one another, to easily identify the relationship between them, but also for providing rock strength and MSE in the same track (here, the fourth track 234). Because the rock strength and the MSE share the same track, a difference between them may be identified (and/or shaded, as shown). The estimate of rock strength is thus easily compared to Mechanical Specific Energy (MSE), which is a measure of the energy used in the drilling process. Accordingly, inefficient drilling can be identified as when the rock strength (which is a measure of the energy necessary to break the rock) deviates from the MSE. Indeed, the gap between rock strength and MSE of the fourth track 234 noticeably grows as the bit wear of the fifth track 238 increases.

Figure 12:
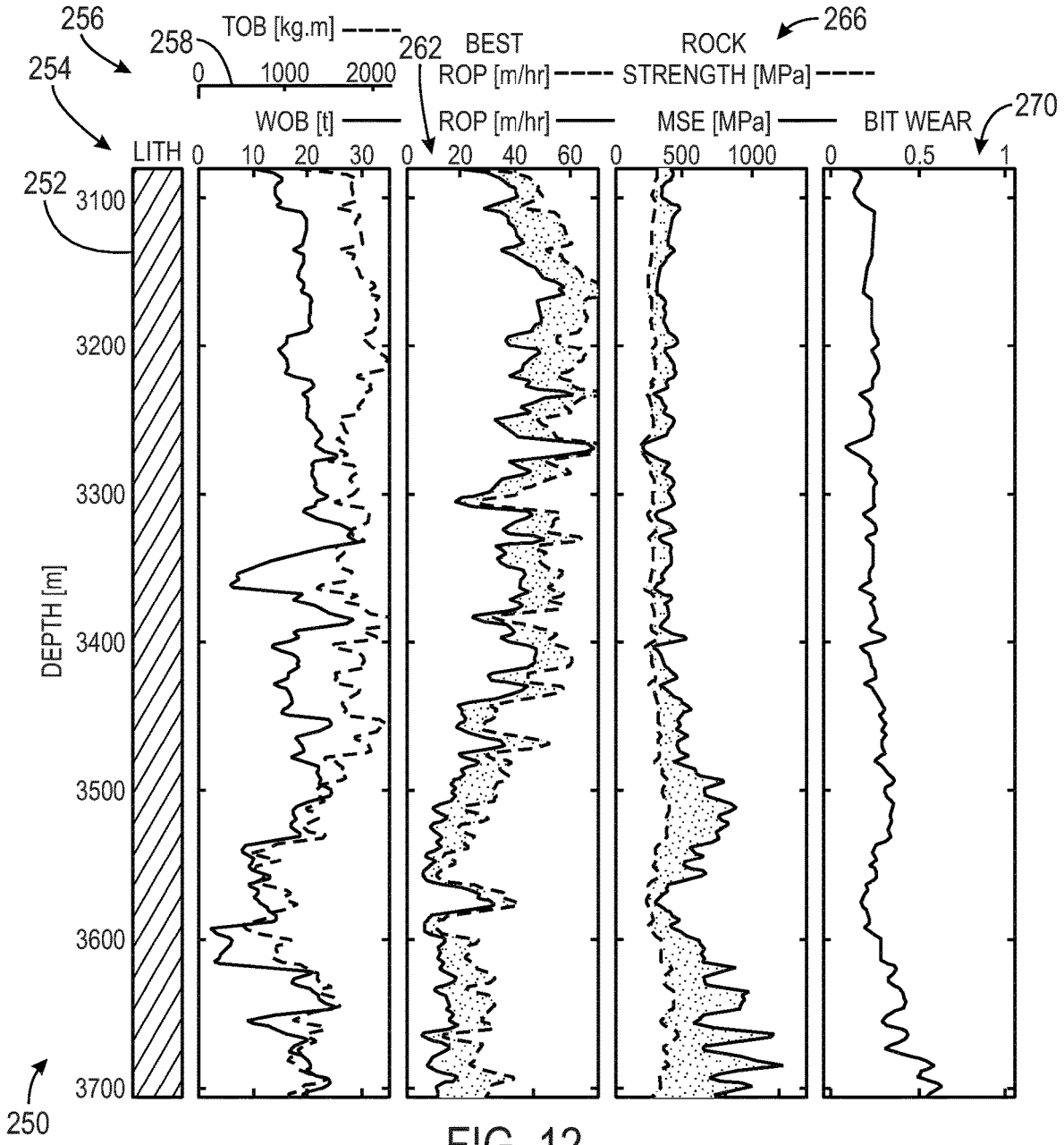
FIG. 12 is an example of a well log that illustrates a measured rate of penetration (ROP) alongside an estimated best possible ROP if the drill bit were replaced with an unworn drill bit, in accordance with an embodiment.

Having estimated the bit wear, rock strength, and other model parameters, a calibrated model of the bit-rock interaction is available. This can be used to predict, for example, the change in rate of penetration (ROP) that may occur if weight-on-bit (WOB) or torque-on-bit (TOB) were changed. It may also be used to predict what the ROP would be if the bit wear were zero—that is, what would be the ROP if a fresh bit was in the hole (using the same WOB and RPM). An example well log 250 shown in FIG. 12 displays this information in a way that a drilling specialist may easily use to make drilling decisions.

The well log 250 illustrates several tracks provided over a range of depths 252. A first track 254 illustrates lithology; a second track 256 illustrates torque-on-bit (TOB) (dashed line 258) and weight-on-bit (WOB) (solid line 260); a third track 262 illustrates actual rate of penetration (ROP) (solid line) alongside an estimate of the best available ROP (dashed line); a fourth track 266 illustrates rock strength (dashed line) and mechanical specific energy (MSE) (solid line) in the manner of the well log 220 of FIG. 11; and a fifth track 270 illustrates bit wear as a value between 0 (no wear) and 1 (completely worn). Because the "Best ROP" and the actual current ROP are shown in the same track, a drilling specialist may be able to easily see what would be the effect of tripping the drill bit to replace it with a fresh bit. A difference between the "Best ROP" and the actual ROP may be emphasized with shading between the two curves.

Figure 13:
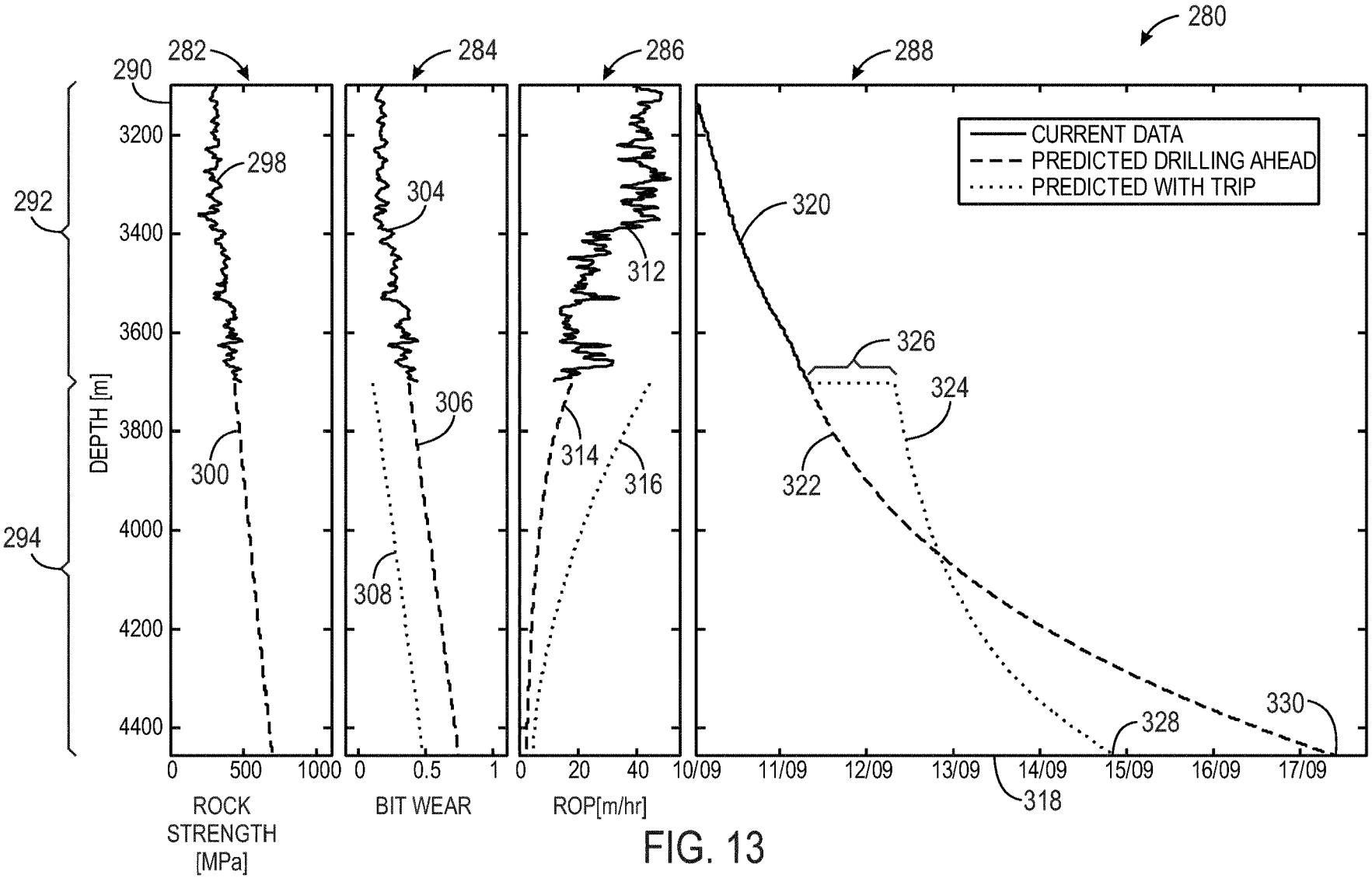
FIG. 13 is an example of a well log that illustrates future rock strength, future bit wear, future ROP, and future time to reach a particular depth depending on whether the bit were replaced, in accordance with an embodiment.

Estimates of the model parameters may be extrapolated to depths ahead of the bit or to new wells. This gives the ability to predict the ROP ahead of the bit or in a future well. This is presented in an example well log 280 of FIG. 13, which illustrates several tracks 282, 284, 286, and 288 over a series of depths 290. A first range of depths 292 represents depths that have already been drilled, while a second range of depths 294 represents depths that have not yet been drilled. The first track 282 illustrates rock strength and includes a modeled portion 298 among the already-drilled depths 292 and a predicted rock strength 300 extrapolated from recent values into the future depths 294. The second track 284, illustrating bit wear, also includes a modeled portion 304 among the already-drilled depths 292 and a predicted bit wear 306 extrapolated from recent values into the future depths 294. The second track 284 also includes an additional predicted bit wear curve 308 that corresponds to a likely value of bit wear if a fresh bit were in place. The third track 286 illustrates rate of penetration (ROP). Like the other tracks, the third track 286 includes a modeled or measured portion 312 among the already-drilled depths 292 and a predicted ROP 314 extrapolated from recent values into the future depths 294. The third track further includes a predicted ROP 316 that corresponds to a likely value of ROP if a fresh bit were in place.

The fourth track 288 compares drilled depths to time 318. A portion 320 shows the amount of time that has passed to drill down through the depths 292 and a predicted portion 322 showing time that is predicted to pass to drill down through the future depths 294. Also shown in the fourth track 288 is the predicted amount of time 324 that may be used to drill through the future depths 294 if the bit were changed for a new bit (assuming a day is used to trip to change the bit, as indicated by portion 326). In this example, it is predicted that by changing the bit at 3700 m, the remaining section would be completed about two days sooner (e.g., at a point 328 rather than 330). This analysis may be done at any depth, so that at any time while drilling, one could determine whether there would be any benefit to tripping to change the bit.

Accordingly, some aspects of the disclosure include:

A method for estimating drilling efficiency parameters, the method comprising:

using a borehole assembly comprising a drill bit to drill into a geological formation;

obtaining a plurality of measurements of weight-on-bit and torque-on-bit during a period in which weight-on-bit and torque-on-bit are non-steady-state; and using the plurality of measurements of weight-on-bit and torque-on-bit to estimate one or more drilling efficiency parameters relating to the drilling of the geological formation during the period.

In the method, the period in which weight-on-bit and torque-on-bit are non-steady-state may comprise:

a drill-on period in which in which weight-on-bit and torque-on-bit increase from an off state to a steady state; or a drill-off period in which weight-on-bit and torque-on-bit decrease from the steady state to the off state.

The one or more drilling efficiency parameters may comprise a friction parameter of the drill bit, a friction parameter of the geological formation, or an approximation of a wear state of the drill bit, or a rock strength or any combination thereof.

Using the plurality of measurements of weight-on-bit and torque-on-bit to estimate the one or more drilling efficiency parameters may comprise generating a crossplot of the plurality of the measurements of weight-on-bit and torque-on-bit over the period and identifying a best-fit curve relating to a predetermined drilling model, wherein the one or at least one of the drilling efficiency parameters are estimated based on one or more properties of the best-fit curve.

The drilling efficiency parameters may be estimated on the crossplot by identifying a steady-state point in the best-fit curve, wherein, beyond the steady-state point, values of weight-on-bit and torque-on-bit increase substantially linearly with respect to one another at a first slope, and using the steady-state point and the first slope to estimate values of the one or more drilling efficiency parameters.

The drilling model may accord with the following relationships:

$$WOB = \zeta \varepsilon r_b \frac{ROP}{RPM} + A_w \varepsilon f\left(\frac{ROP}{RPM}\right); \text{ and}$$

$$TOB = \frac{1}{2} \varepsilon r_b^2 \frac{ROP}{RPM} + \mu r_b A_w \varepsilon f\left(\frac{ROP}{RPM}\right);$$

where

WOB represents weight-on-bit,

TOB represents the torque-on-bit;

ROP represents a rate of penetration of the drill bit into the geological formation;

RPM represents a rotation speed of the drill bit;

$r_b$ represents a radius of the drill bit;

ε represents an amount of energy used to cut into the geological formation, or rock strength;

$A_w$ represents an area of wear flat on the drill bit, or bit wear; and

ζ and μ represent friction parameters relating to friction between the drill bit and the geological formation.

In some embodiments, at least part of the plurality of measurements of weight-on-bit and/or torque-on-bit are obtained by a downhole tool of the bottom hole assembly.

In some embodiments, at least part of the plurality of measurements of weight-on-bit and/or torque-on-bit are obtained at the surface.

When the plurality of measurements of weight-on-bit and torque-on-bit are obtained by the downhole tool, the measurements may be obtained at a sampling rate higher than an immediately available data transfer rate of a telemetry system associated with the downhole tool, and wherein the plurality of measurements of weight-on-bit and torque-on-bit are transferred to a data processing system by the telemetry system at least partly during a steady-state period of drilling over a longer time than was taken to obtain the plurality of measurements of weight-on-bit and torque-on-bit.

The method may comprise:

repeating the method during a plurality of additional periods of drilling in which weight-on-bit and torque-on-bit are non-steady-state to estimate the one or more drilling efficiency parameters at a plurality of depths; and interpolating interim values of the one or more drilling efficiency parameters for depths between the plurality of depths to obtain a depth log of the one or more drilling efficiency parameters.

The method may comprise:

obtaining an estimation of a rock strength ε via a log performed downhole, such as a sonic log; and estimating the drill bit wear via the drilling model and the drilling efficiency parameters determined during the non-steady state period and the rock strength determined by the downhole log.

The drill bit wear may be determined on the basis of the parameters identified thanks to the drilling model or by taking additional WOB, TOB, RPM and ROP measurements.

The method may comprise:

taking additional measurements of weight on bit and/or torque on bit, and further measurements of rate of penetration (ROP) and rotation speed (RPM) during periods of drilling in which weight-on-bit and torque-on-bit are in a steady state;

comparing, at a plurality of depths and for a plurality of predetermined drill bit wear values, a value of weight on bit and/or torque on bit estimated via the drilling efficiency model with the already determined drilling efficiency parameters and measured ROP and RPM and a measured value of the weight on bit and/or torque on bit during a steady state period; and determining an estimated drill bit wear at the plurality of depths based on the comparison.

The measurements may be averaged over intervals of depth.

The measurements may be obtained by a downhole tool.

The measurements may be obtained at the surface.

The method may comprise:

determining a matrix of likelihoods of possible drill bit wear at a plurality of depths of the geological formation based on the comparison;

wherein determining an estimated drill bit wear at the plurality of depths is based on the matrix, and takes into account, for determining the drill bit wear at at least one depth, the drill bit wear at at least one other depth.

The method may include determining the estimated bit wear by determining a best-fit path through the matrix of likelihoods in which drill bit wear does not decrease with increasing depth.

Determining the estimated bit wear may comprise using a dynamic time warping approach.

The matrix of likelihoods may be determined in accordance with the following relationship:

$$-L(d, A_w) = \frac{|WOB(d) - \widetilde{WOB}(d, A_w)|^2}{\sigma_W^2} + \frac{|TOB(d) - \widetilde{TOB}(d, A_W)|^2}{\sigma_T^2};$$

where:

WOB(d) and TOB(d) represent measurements of weight-on-bit and torque-on-bit at depth d; d;

$\widetilde{WOB}(d,A_w)$ and $\widetilde{TOB}(d,A_w)$ represent modelled values of weight-on-bit and torque-on-bit at bit at depth d and bit wear $A_w$; and $\sigma_W^2$ and $\sigma_T^2$ represent a measurement uncertainty on weight-on-bit and torque-on-bit.

A system may comprise:

a borehole assembly comprising a drill bit configured to drill into a geological formation as a weight-on-bit and a torque-on-bit is applied, wherein the drill bit wears down as the drill bit drills through depths of the geological formation to a greater extent through parts of the geological formation having a greater intrinsic energy;

a measuring assembly for obtaining a plurality of measurements of weight-on-bit and torque-on-bit, at least during a period in which weight-on-bit and torque-on-bit are non-steady-state; and a data processing system configured to use the plurality of measurements of weight-on-bit and torque-on-bit to estimate one or more drilling efficiency parameters relating to the drilling of the geological formation during the period.

The measurement assembly may comprise a component of a downhole tool.

The component of the downhole tool may comprise a strain gauge.

The measurement assembly may comprise a component at the surface.

The data processing system may be situated downhole and/or at the surface.

The data processing system may estimate the one or more drilling efficiency parameters using any of the disclosed methods.

At least part of the measuring assembly may be situated in the borehole assembly, wherein the borehole assembly also comprises a telemetry system for transferring the measurements to the data processing system, wherein the telemetry system is configured to send the measurements at least partly during a steady-state period of drilling over a longer time than was taken to obtain the plurality of measurements of weight-on-bit and torque-on-bit.

At least part of the measuring assembly may be located at the surface.

A method for determining drilling efficiency parameters of a drilling operation comprising:

using a drill bit of a borehole assembly comprising a drill bit to drill into a geological formation;

using a downhole tool of the borehole assembly to obtain measurements of weight-on-bit and torque-on-bit during a drill-on or a drill-off period, wherein the measurements are obtained at a sampling rate higher than an available data transfer rate of a telemetry system associated with the downhole tool; and using the telemetry system to transfer the measurements to a data processing system at the surface at least partly after the drill-on or the drill-off period.

The downhole tool may identify when the drill-on or the drill-off period begins and begin obtaining the measurements when the drill-on or the drill-off period has been identified as beginning.

The downhole tool may be instructed that the drill-on or the drill-off period is about to begin by a data processing system at the surface and the downhole tool may begin obtaining the measurements upon receipt of the instructions.

The downhole tool may comprise a strain gauge.

The measurements may be obtained at approximately 1 per second or faster.

The measurements may be transferred to the surface by the telemetry system in an extra data point added to a plurality of data frames being transmitted during normal drilling after the drill-on or the drill-off period.

The measurements may be transferred to the surface by the telemetry system all at once after the drill-on or drill-off period.

The telemetry system may be an electromagnetic (EM) system, a mud pulse system, or an acoustic wave propagation system.

The disclosure also relates to a method for displaying drilling efficiency parameters, comprising:

providing a well log of a plurality of depths of a well, wherein the well log shows intrinsic energy of rock and mechanical specific energy (MSE) in the same track, thereby providing an indication of drilling efficiency to the extent that intrinsic energy of the rock deviates from MSE.

The area between the intrinsic energy of the rock and the MSE may be colored or shaded to make the difference between the intrinsic energy of the rock and the MSE stand out.

The disclosure also relates to a method for displaying drilling efficiency parameters while a well is being drilled, the method comprising:

drilling a well into a geological formation using a drill bit on a borehole assembly, wherein the drill bit is configured to wear down as the drill bit drills through depths of the geological formation to a greater extent through parts of the geological formation having a greater intrinsic energy;

providing a well log for a plurality of depths of the well, wherein the well log illustrates a measured rate of penetration (ROP) of the drill bit through the geological formation alongside an estimated best possible ROP if the drill bit were not worn.

The area between the measured ROP and the estimated best possible ROP may be colored or shaded to make the difference between the measured ROP and the estimated best possible ROP stand out.

The best possible ROP may be estimated based at least in part on a drill bit wear that is estimated to have occurred or that is estimated to occur at depths in the future based on a drilling efficiency model.

The drilling efficiency model may accord with the relationships of EQ. 1 and EQ. 2 above.

The disclosure also relates to a method for displaying drilling efficiency parameters while a well is being drilled, the method comprising:

drilling a well into a geological formation using a drill bit on a borehole assembly, wherein the drill bit is configured to wear down as the drill bit drills through depths of the geological formation to a greater extent through parts of the geological formation having a greater intrinsic energy;

providing a well log for a plurality of depths of the well, wherein the well log illustrates predicted values of drilling parameters for a first scenario in which the drill bit is not replaced and for a second scenario in which the drill bit is replaced with a fresh drill bit.

The drilling parameters may include an amount of drill bit wear that would be predicted to occur without replacing the drill bit and an amount of drill bit wear that would be predicted to occur if the drill bit were replaced with the fresh drill bit.

The drilling parameters may include a predicted rate of penetration (ROP) of the drill bit without replacement alongside a predicted ROP if the drill bit were replaced with the fresh drill bit.

The drilling parameters may include a predicted time of completion of the well without replacing the drill bit alongside a predicted time of completion if the drill bit were replaced with the fresh drill bit.

The drilling efficiency parameters may be predicted based at least in part on a drilling efficiency model.

The drilling efficiency model may accord with the relationships of EQ. 1 and EQ. 2 above.

The specific embodiments described throughout this disclosure have been shown by way of example, and it should be understood that these embodiments may be susceptible to various modifications and alternative forms. It should be further understood that the claims are not intended to be limited to the particular forms disclosed, but rather to cover modifications, equivalents, and alternatives falling within the spirit and scope of this disclosure.

The invention claimed is:

1. A method for estimating a parameter related to drill bit wear during a subterranean drilling operation, the method comprising:

(a) rotating a drill bit in a wellbore to drill into a subterranean formation, the drill bit having an unknown bit wear;

(b) measuring a set of corresponding weight on bit (WOB) and torque on bit (TOB) values while rotating in (a), the set measured when WOB and TOB values ramp up from lower values after a pause in drilling or ramp down from higher values as drilling pauses, said measurements made at a frequency of at least 1 Hz during said ramp up or ramp down;

(c) fitting a nonlinear curve to a cross plot of the measured set of WOB and TOB values, the cross plot having TOB on the ordinate and WOB on the abscissa;

(d) evaluating the nonlinear curve to obtain the parameter related to drill bit wear, said evaluating including locating a steady state point in the nonlinear curve above which the curve is substantially linear, wherein the parameter related to drill bit wear is equal to a WOB value at the steady state point and is a product of a rock strength ε of the subterranean formation and an area of a wear flat $A_w$, on the drill bit, the area of the wear flat being indicative of the drill bit wear;

(e) resuming drilling using a weight on bit above the WOB value at the steady state point;

(f) measuring a rate of penetration of drilling (ROP), a rotation rate of the drill bit (RPM), the TOB, and the WOB while drilling in (e);

(g) processing the ROP and the RPM measured in (f) and the parameter related to drill bit wear obtained in (d) to compute a modeled WOB and a modeled TOB at a plurality of estimated values of the area of the wear flat; and (h) comparing the modeled WOB and the modeled TOB computed in (g) and the WOB and TOB measured in (f) at each of the values of the area of the wear flat to determine a likelihood of each area of the wear flat being correct.

2. The method of claim 1, wherein (d) further comprises: further evaluating the nonlinear curve to determine at least one friction parameter related to a friction between the drill bit and the subterranean formation, the friction parameter determined by extrapolating said substantially linear portion of the nonlinear curve to the abscissa at which the WOB value is equal to $\varepsilon A_w(1-\mu\zeta)$ wherein $\mu\zeta$ represents the at least one friction parameter.

3. The method of claim 1, further comprising:

obtaining an estimate of the rock strength ε from a logging measurement performed while drilling in (a); and processing the obtained rock strength and the product obtained in (d) to compute the area of the wear flat.

4. The method of claim 1, wherein:

at least a subset of the corresponding WOB and TOB values are measured in a downhole tool in (b), said measurement frequency is higher than an immediately available data transfer rate of a telemetry system associated with the downhole tool;

the at least one of the WOB values and the TOB values measured in the downhole tool are transmitted to a surface location by the telemetry system during said resumed drilling in (e), wherein said fitting and said evaluating in (c) and (d) are performed at the surface location.

5. The method of claim 1, further comprising:

(i) repeating (f), (g), and (h) at a plurality of depths in the wellbore to generate a matrix of likelihoods, the matrix of likelihoods being a two dimensional matrix of the likelihood values computed in (h) as a function of the depth and the area of the wear flat.

6. The method of claim 5, wherein the matrix of likelihoods is computed using the following equation:

$$-L(d, A_w) = \frac{\left|WOB(d) - \widehat{WOB}(d, A_w)\right|^2}{\sigma_W^2} + \frac{\left|TOB(d) - \widehat{TOB}(d, A_w)\right|^2}{\sigma_T^2}$$

wherein $L(d, A_w)$ represents the matrix of likelihoods at the plurality of depths d and the plurality of estimated values of the area of the wear flat $A_w$, WOB (d) and TOB (d) represent the WOB and TOB values measured in (f), $\widehat{WOB}(d,A_w)$ and $\widehat{TOB}(d,A_w)$ represent the modelled WOB and the modelled TOB values computed in (g), and $\sigma_w$ and $\sigma_T$ represent measurement uncertainties for the WOB and TOB values measured in (f).

7. The method of claim 5, further comprising:

(j) evaluating the matrix of likelihoods to determine a best fit path indicating a most likely bit wear as a function of depth in the wellbore.

8. The method of claim 1, further comprising:

(i) processing the ROP, the RPM, the TOB, and the WOB measured in (f) in combination with an area of the wear flat having a highest likelihood of being correct to compute a formation strength.

* * * * *